US008733899B2

(12) United States Patent
Oosugi

(10) Patent No.: US 8,733,899 B2
(45) Date of Patent: May 27, 2014

(54) INKJET HEAD AND METHOD OF MANUFACTURING THE SAME

(75) Inventor: Yukihiro Oosugi, Izunokuni (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/413,803

(22) Filed: Mar. 7, 2012

(65) Prior Publication Data

US 2012/0229571 A1 Sep. 13, 2012

(30) Foreign Application Priority Data

Mar. 8, 2011 (JP) ..... 2011-050531

(51) Int. Cl.
*B41J 2/14* (2006.01)

(52) U.S. Cl.
USPC ..... 347/47

(58) Field of Classification Search
USPC ..... 347/47
See application file for complete search history.

(56) References Cited

U.S. PATENT DOCUMENTS 8,113,633 B2 * 2/2012 Hirasawa et al. ..... 347/71

FOREIGN PATENT DOCUMENTS

| | | |
|---|---|---|
| JP | 08-174832 | 7/1996 |
| JP | 11-286111 | 10/1999 |
| JP | 2000-211145 | 8/2000 |
| JP | 2001-047620 | 2/2001 |
| JP | 2005-125768 | 5/2005 |
| JP | 2009-196122 | 9/2009 |

OTHER PUBLICATIONS

Japanese Office Action for Japanese Application No. 2011-050531 mailed on Aug. 6, 2013.

Office Action of Decision of Rejection for Japanese Patent Application No. 2011-050531 Dated Oct. 29, 2013, 2 pgs.

* cited by examiner

*Primary Examiner* — Lamson Nguyen

(74) *Attorney, Agent, or Firm* — Amin, Turocy & Watson, LLP

(57) ABSTRACT

According to one embodiment, an inkjet head includes a base member, a nozzle plate, a frame and an adhesive. The nozzle plate is opposed to the base member. The frame is interposed between the base member and the nozzle plate, the frame including an adhering surface to which the nozzle plate is adhered, and a groove which is provided in the adhering surface. The adhesive is interposed between the adhering surface and the nozzle plate.

10 Claims, 9 Drawing Sheets

INKJET HEAD AND METHOD OF MANUFACTURING THE SAME

CROSS-REFERENCE TO RELATED APPLICATIONS

This application is based upon and claims the benefit of priority from prior Japanese Patent Application No. 2011-050531, filed on Mar. 8, 2011, the entire contents of which are incorporated herein by reference.

FIELD

Embodiments described herein relate generally to an inkjet head and a method of manufacturing the inkjet head.

BACKGROUND

Inkjet heads of a so-called side-shooter type have a base plate, a frame, and a nozzle plate. The frame is adhered to the base plate to which a piezoelectric element is attached. The nozzle plate is adhered to the frame.

Ink is supplied from an ink tank to an ink chamber which is enclosed by the base plate, the frame, and the nozzle plate. The ink is supplied to pressure chambers of the piezoelectric element, and ejected from nozzles provided on the nozzle plate by the piezoelectric element.

The nozzle plate is attached to the frame by a thermosetting adhesive. When the adhesive is cured, gas which is produced by chemical reaction may cause air bubbles to form between the nozzle plate and the frame. Such air bubbles lift up the nozzle plate, and raise projections on a surface of the nozzle plate.

DETAILED DESCRIPTION

In general, according to one embodiment, an inkjet head includes a base member, a nozzle plate, a frame and an adhesive. The nozzle plate is opposed to the base member. The frame is interposed between the base member and the nozzle plate, the frame including an adhering surface to which the nozzle plate is adhered, and a groove which is provided in the adhering surface. The adhesive is interposed between the adhering surface and the nozzle plate.

Figure 1:
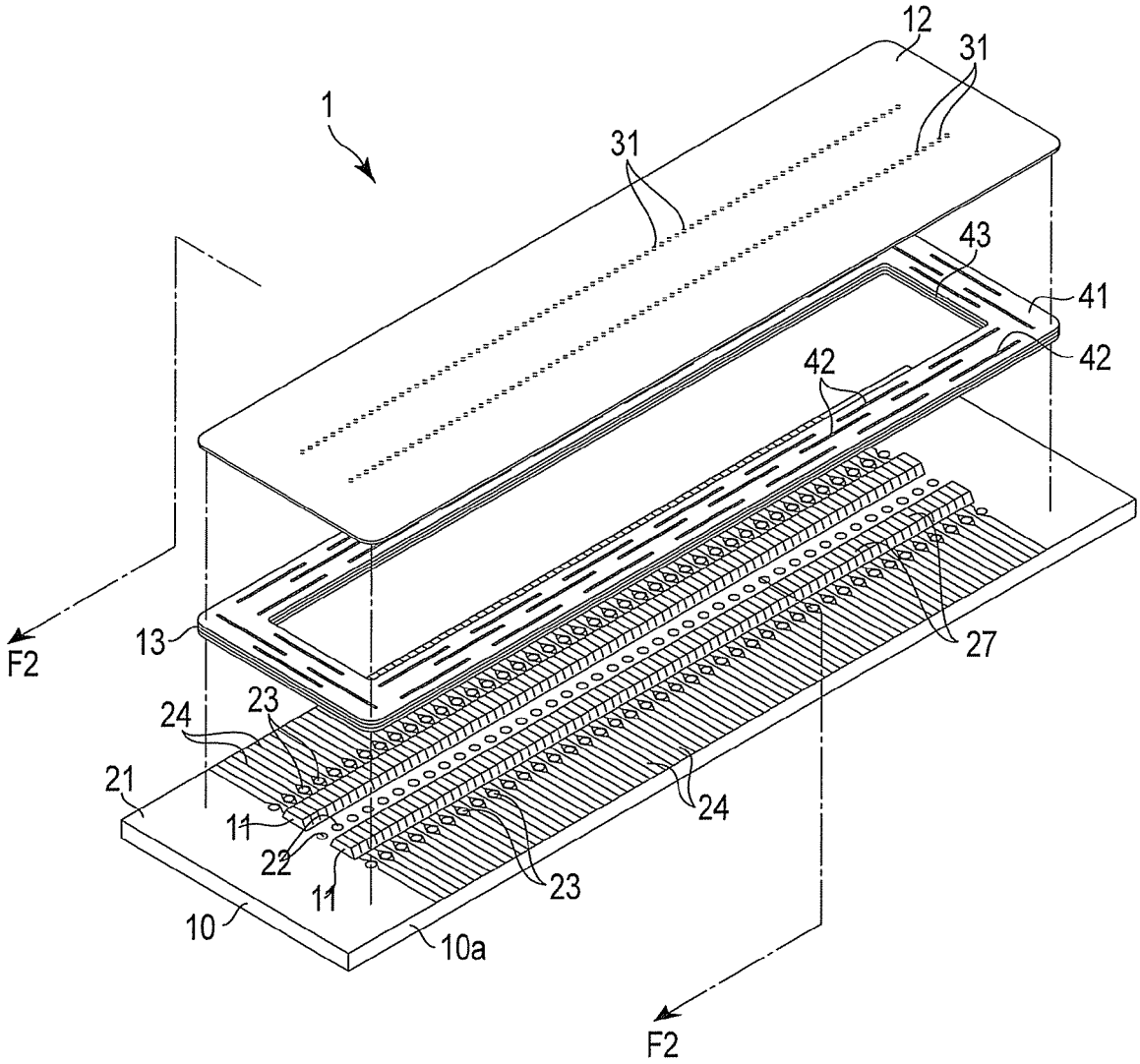
FIG. 1 is an exemplary exploded perspective view of an inkjet head according to a first embodiment.
Figure 2:
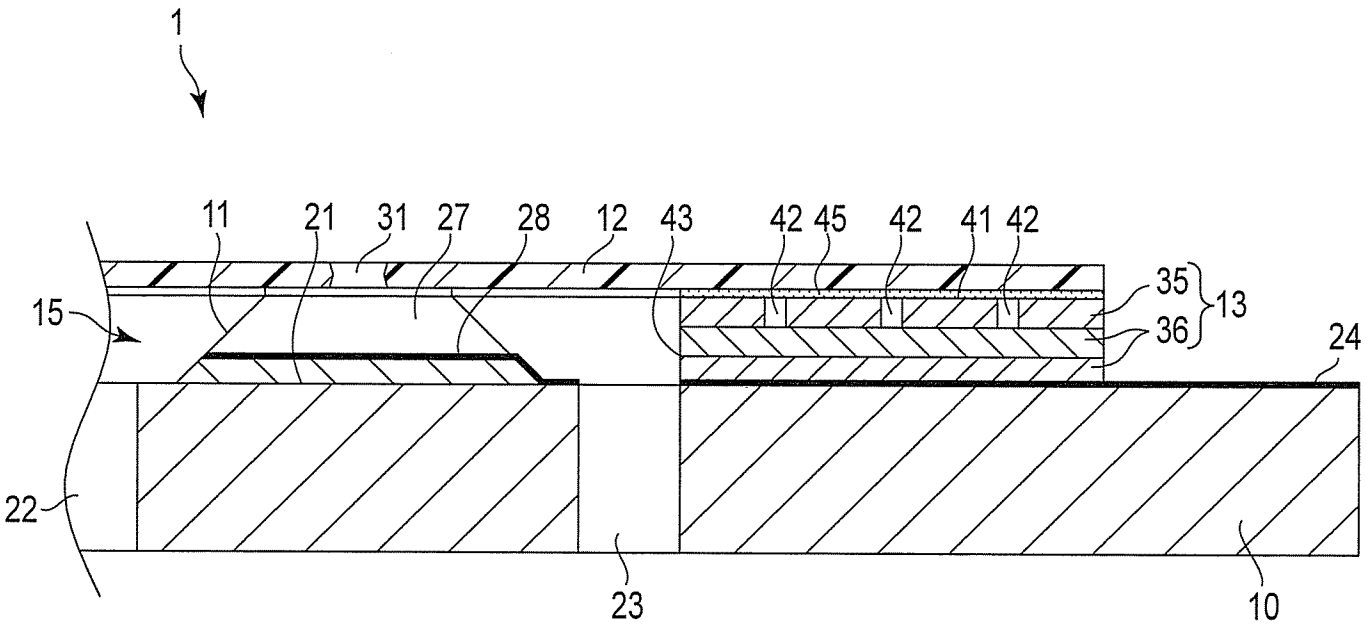
FIG. 2 is an exemplary cross-sectional view of the inkjet head of the first embodiment, taken along line F2-F2 of FIG. 1.

A first embodiment will be explained hereinafter with reference to FIG. 1 to FIG. 3. FIG. 1 is an exploded perspective view of an inkjet head 1 according to the first embodiment. FIG. 2 is a cross-sectional view of the inkjet head 1, taken along line F2-F2 of FIG. 1.

As illustrated in FIG. 1, the inkjet head 1 is an inkjet head of a so-called side-shooter type. The inkjet head 1 comprises a base plate 10, a pair of driving elements 11, a nozzle plate 12, and a frame 13. The base plate 10 is an example of a base member.

As illustrated in FIG. 2, an ink chamber 15 is provided inside the inkjet head 1. The ink chamber 15 is enclosed by the base plate 10, the nozzle plate 12, and the frame 13, and supplied with printing ink.

The base plate 10 is formed of ceramic, such as alumina, and has a rectangular plate shape. The base plate 10 includes a flat surface 21. As illustrated in FIG. 1, the surface 21 of the base plate 10 is provided with a plurality of supply holes 22, a plurality of discharge holes 23, and a plurality of electrical traces 24.

The supply holes 22 are arranged in a center part of the base plate 10, and arranged in a line along a longitudinal direction of the base plate 10. The supply holes 22 are open to the ink chamber 15, and connected to an ink tank through a manifold. Ink in the ink tank is supplied to the ink chamber 15 through the supply holes 22.

The discharge holes 23 are arranged in two lines along the longitudinal direction of the base plate 10, to hold the line of the supply holes 22 therebetween. The discharge holes 23 are open to the ink chamber 15, and connected to the ink tank through a manifold. Ink of the ink chamber 15 is collected into the ink tank through the discharge holes 23.

The electrical traces 24 are formed of, for example, a nickel thin film which is formed by electroless plating. Each of the electrical traces 24 extends from a side edge 10*a* of the base plate 10 toward the center part of the base plate 10. The electrical traces 24 are electrically connected to an IC which controls the driving elements 11.

Each of the driving elements 11 is, for example, a piezoelectric element which is formed of lead zirconate titanate (PZT), and has a bar shape. Each of the driving elements 11 is adhered to the surface 21 of the base plate 10. The driving elements 11 are arranged in parallel with each other in the ink chamber 15.

Each driving element 11 is provided with a plurality of pressure chambers 27 to eject ink. The pressure chambers 27 are grooves which are provided in each driving element 11. Each pressure chamber 27 has a width of, for example, 80 μm. As illustrated in FIG. 2, the pressure chambers 27 are covered with electrodes 28. The electrodes 28 are electrically connected with the electrical traces 24.

The IC applies a voltage to the electrodes 28 through the respective electrical traces 24, based on a signal which is inputted from a controller of the inkjet printer. Thereby, the driving elements 11 shear, and pressurize ink supplied to the pressure chambers 27.

The nozzle plate 12 is formed of a rectangular film formed of polyimide. The nozzle plate 12 is not limited to this structure, but may be formed of another resin material which can be processed by laser. The nozzle plate 12 is attached to the base plate 10 with the frame 13 interposed therebetween, and opposed to the base plate 10. The nozzle plate 12 has a thickness of, for example, 20 to 50 μm.

The nozzle plate 12 is provided with a plurality of nozzles 31. The nozzles 31 are holes which are formed in the nozzle plate 12, and each of which is open to the ink chamber 15. The nozzles 31 are arranged to correspond to the respective pressure chambers 27. The ink which is pressurized in the pressure chambers 27 is ejected from the corresponding nozzles 31.

As illustrated in FIG. 1, the frame 13 is formed in a rectangular frame shape. FIG. 3 is an exploded perspective view of the frame 13. As illustrated in FIG. 3, the frame 13 is formed of a first plate 35 and two second plates 36, which are formed of nickel alloy.

As illustrated in FIG. 2, the frame 13 is adhered to the surface 21 of the base plate 10. The frame 13 is interposed between the base plate 10 and the nozzle plate 12, and produces a space between the base plate 10 and the nozzle plate 12.

The frame 13 includes a flat adhering surface 41, a plurality of grooves 42, and an opening part 43 which is defined by an inner edge of the frame 13. The adhering surface 41 is located on a reverse side of a surface which is adhered to the base plate 10. The nozzle plate 12 is adhered to the adhering surface 41 by adhesive 45.

The adhesive 45 is, for example, a one-part epoxy-based adhesive. The adhesive 45 is applied to the adhering surface 41 of the frame 13, and top parts of the driving elements 11. The adhesive 45 is interposed between the adhering surface 41 and the nozzle plate 12, and adheres the nozzle plate 12 to the frame 13. The adhesive 45 is also interposed between the top parts of the driving elements 11 and the nozzle plate 12, and adheres the driving elements 11 to the nozzle plate 12.

As illustrated in FIG. 1, the grooves 42 are formed in the adhering surface 41. The grooves 42 are formed along edges of the adhering surface 41. The grooves 42 are intermittently arranged in three lines. The grooves 42 are not open to the ink chamber 15, but arranged apart from the ink chamber 15. In other words, the grooves 42 are separated from the ink chamber 15. In addition, the grooves 42 are not open to the outside of the inkjet head 1. In other words, the grooves 42 are separated from the atmosphere. The grooves 42 are only open in the adhering surface 41.

Each groove 42 has a depth of, for example, 0.1 mm. Each groove 42 has a width of, for example, 30 to 100 μm. The size of the grooves 42 is not limited to it, but can be determined according to conditions such as a distance between adjacent grooves 42.

The following is an example of part of a manufacturing process of the inkjet head 1. First, discharge holes 23 and supply holes 22 are formed in a base plate 10 which is formed of a ceramic sheet before sintering (ceramic green sheet). Then, the base plate 10 is sintered.

Thereafter, a pair of driving elements 11 are adhered to the base plate 10. In this processing, a distance between the driving elements 11 is fixed by a jig (not shown). The driving elements 11 are positioned by the jig, and adhered to the base plate 10.

Then, corner parts of the driving elements 11 which are adhered to the base plate 10 are subjected to grinding or tapering to perform grinding. A plurality of grooves which serve as pressure chambers 27 are formed in each of the driving elements 11. This processing is performed by using, for example, a diamond wheel of a dicing saw which is used for cutting IC wafers.

Thereafter, electrodes 28 are formed on respective internal surfaces of the grooves, and a plurality of electrical traces 24 are formed on a surface 21 of the base plate 10. The electrical traces 24 and the electrodes 28 are formed of, for example, a nickel thin film which is formed by electroless plating. Then, patterning is performed by laser irradiation, and thereby the nickel thin film is removed from parts other than the electrical traces 24 and the electrodes 28.

Next, a frame 13 is formed. First, a plate material formed of nickel alloy is etched, and thereby a first plate 35 and two second plates 36 are formed.

Figure 3:
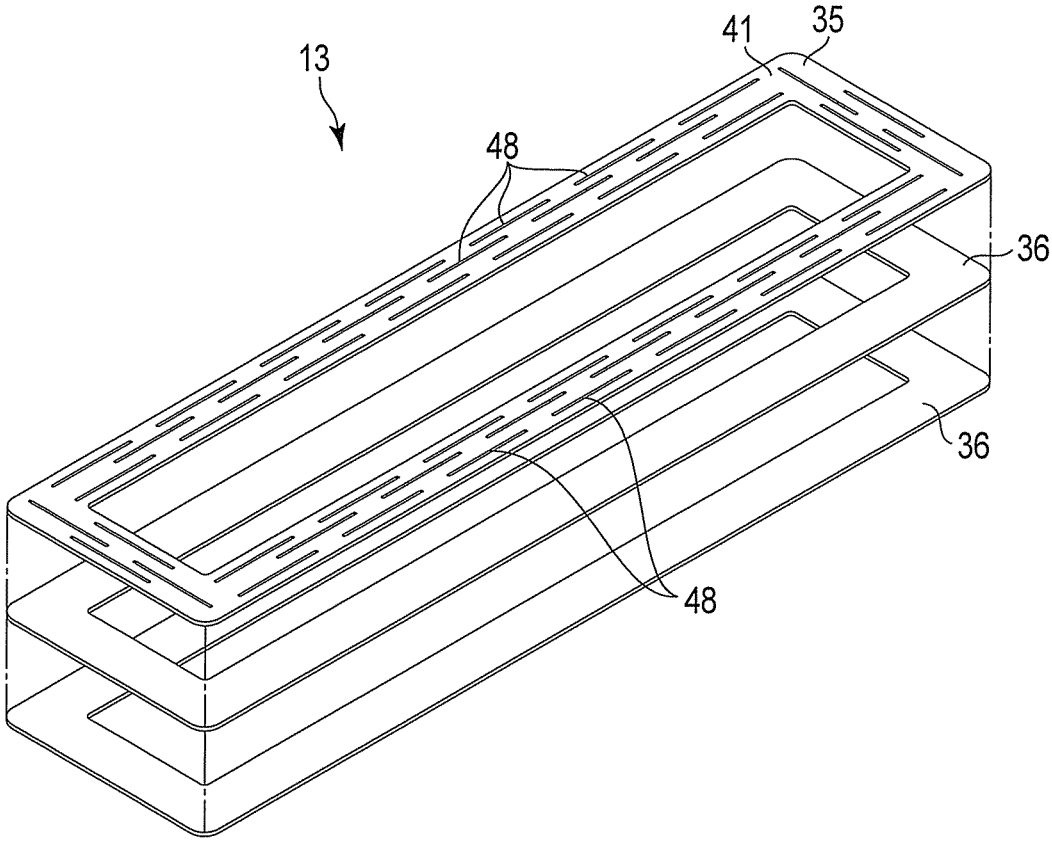
FIG. 3 is an exemplary exploded perspective view of a frame of the first embodiment.

As illustrated in FIG. 3, the first plate 35 includes the adhering surface 41 of the frame 13. The first plate 35 includes part of the opening part 43 of the frame 13, and a plurality of slits 48.

The part of the opening part 43 and the slits 48 are open in the adhering surface 41, and penetrate the first plate 35. The part of the opening part 43 and the slits 48 are simultaneously formed by, for example, etching. The method of forming the slits 48 is not limited to etching, but another method such as pressing may be used.

Each of the two second plates 36 includes part of the opening part 43. The part of the opening part 43 is formed by, for example, etching. The second plates 36 may have a thickness and a width which are different from those of the first plate 35.

Next, the first plate 35 is temporarily adhered to the second plates 36 by an adhesive. The first plate 35 and the second plates 36 which are temporarily adhered to each other are bonded, and thereby the frame 13 is formed. The bonding is performed by, for example, diffusion bonding. The bonding is not limited to diffusion bonding, but another bonding method such as anodic bonding and another vacuum bonding may be used.

By bonding the first plate 35 to the second plates 36, the second plates 36 cover the slits 48 from one side. The slits 48 which are covered from one side form a plurality of grooves 42. Thereby, the frame 13 is formed.

The method of forming the frame 13 is not limited to the above method. For example, the first plate 35 may be provided with no slits 48, but grooves 42 may be formed by etching after the first plate 35 is bonded to the second plates 36. The method of forming the grooves 42 is not limited to etching, but another method such as pressing, sandpapering, and sandblast may be used. In addition, the grooves 42 may have a depth which is smaller than the thickness of the first plate 35.

Thereafter, the formed frame 13 is adhered to the base plate 10. Next, an adhesive 45 is applied to the adhering surface 41 of the frame 13 by, for example, a dispenser. The adhesive 45 may be provided outside the grooves 42 of the frame 13, or enter the grooves 42. The nozzle plate 12 is adhered to the frame 13 by the adhesive 45.

Next, the adhesive 45 is cured by heat. Curing of the adhesive 45 is not limited to curing by heat, but may be curing by ultraviolet rays or with lapse of time. The adhesive 45 produces gas by chemical reaction in curing by heat. The gas does not become air bubbles between the nozzle plate 12 and the frame 13, but enters the grooves 42.

After the adhesive 45 is cured, a plurality of nozzles 31 are formed by irradiating the nozzle plate 18 with laser beams. By the above process, the inkjet head 1 illustrated in FIG. 1 is formed.

According to the inkjet head 1 having the above structure, the adhering surface 41 to which the adhesive 45 is applied is provided with the grooves 42. Therefore, the gas produced from the adhesive 45 runs into the grooves 42. Therefore, it is suppressed that air bubbles lift up the nozzle plate 12 and that projections are formed on the surface of the nozzle plate 12.

In addition, even when minute dust exists between the nozzle plate 12 and the adhering surface 41 when the adhesive 45 is applied, the dust enters the grooves 42. Thereby, it is suppressed that dust lifts up the nozzle plate 12 and that projections are formed on the surface of the nozzle plate 12.

The nozzle plate 12 is formed of a thin polyimide film. Therefore, the nozzle plate 12 is more easily influenced by air bubbles and dust, and more easily produces projections by air bubbles and dust, than a member such as the base plate 10 which is formed of ceramic. Therefore, the adhering surface 41 to which the nozzle plate 12 is attached is provided with the grooves 42, and thereby influence by air bubbles and dust is suppressed.

In an inkjet printer, the surface of the nozzle plate 12 is sometimes wiped off by a wiper for cleaning of the inkjet head 1. When projections are formed on the surface of the nozzle plate 12, the wiper may be broken, and ink ejection performance thereof may decrease by ink which remains on the surface of the nozzle plate 12. Therefore, according to the inkjet head 1 which suppresses production of projections, it is possible to suppress breakage of the wiper and decrease in ink ejection performance.

The grooves 42 of the frame 13 are provided apart from the ink chamber 15. Therefore, it is possible to prevent ink of the ink chamber 15 from flowing into the grooves 42, and remaining and changing characteristic of ink flow.

The grooves 42 of the frame 13 are formed of the slits 48 that are provided in the first plate 35. Thereby, the slits 48 are easily formed simultaneously with part of the opening part 43, which penetrates the first plate 35 like the slits 48. This structure suppresses increase in manufacturing steps of the inkjet head 1, and prevents increase in manufacturing cost of the inkjet head 1.

Next, a second embodiment of the inkjet head will be explained hereinafter with reference to FIG. 4. In the following embodiments disclosed hereinafter, constituent elements which have the same functions as those of the inkjet head 1 of the first embodiment will be denoted by the same respective reference numbers, and explanations thereof are omitted.

Figure 4:
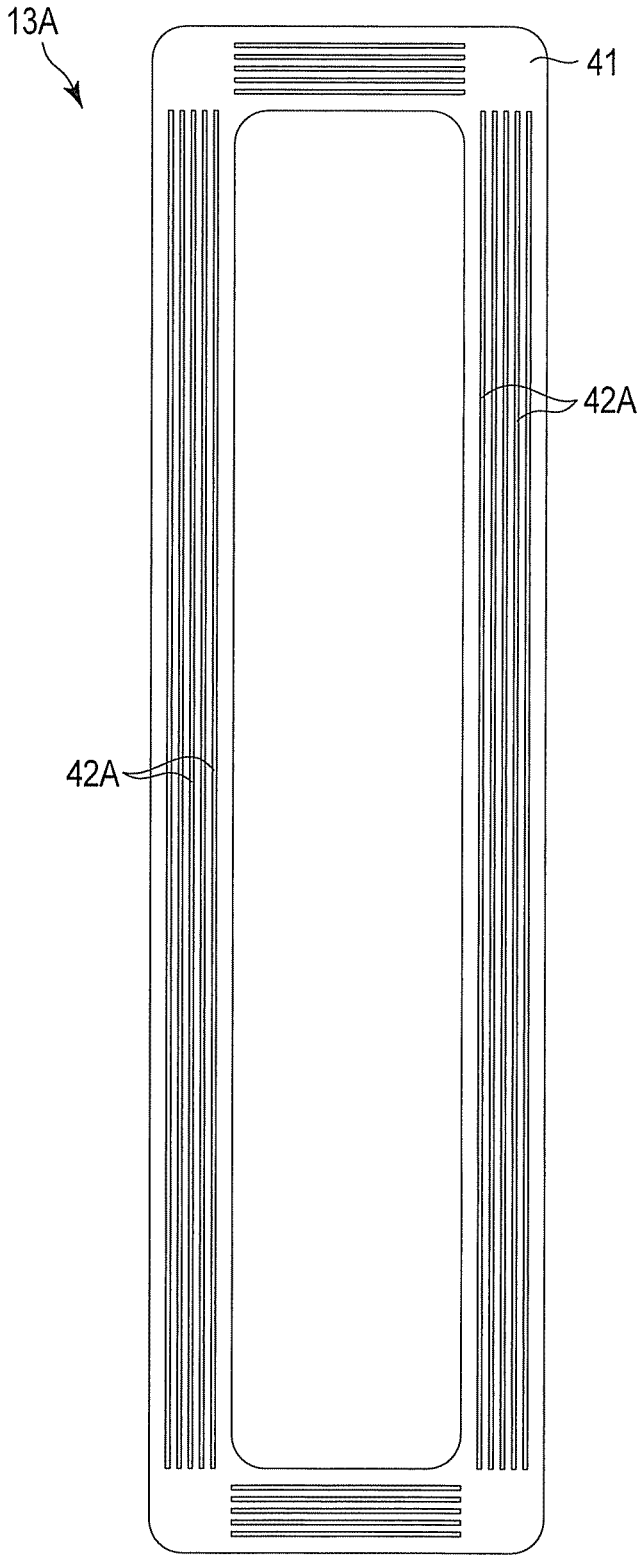
FIG. 4 is an exemplary plan view of a frame according to a second embodiment.

FIG. 4 is a plan view of a frame 13A according to the second embodiment. As illustrated in FIG. 4, an adhering surface 41 of the frame 13A is provided with a plurality of grooves 42A. The grooves 42A are arranged in five lines along edges of the frame 13A. Each of the grooves 42A continuously extends from one end to the other end of a side of the frame 13A, unlike the grooves 42 of the first embodiment which are intermittently arranged. The frame 13A having the above structure has the same function as that of the frame 13 of the first embodiment.

Figure 5:
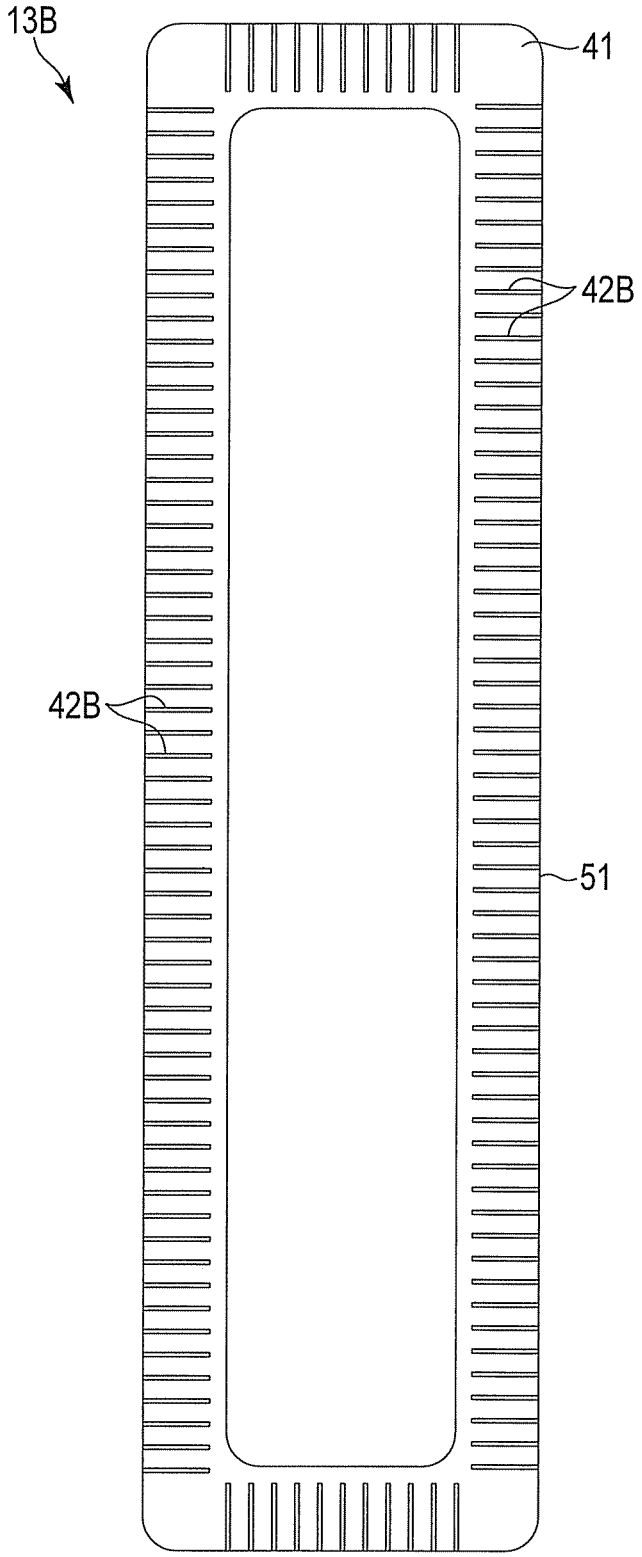
FIG. 5 is an exemplary plan view of a frame according to a third embodiment.
Figure 6:
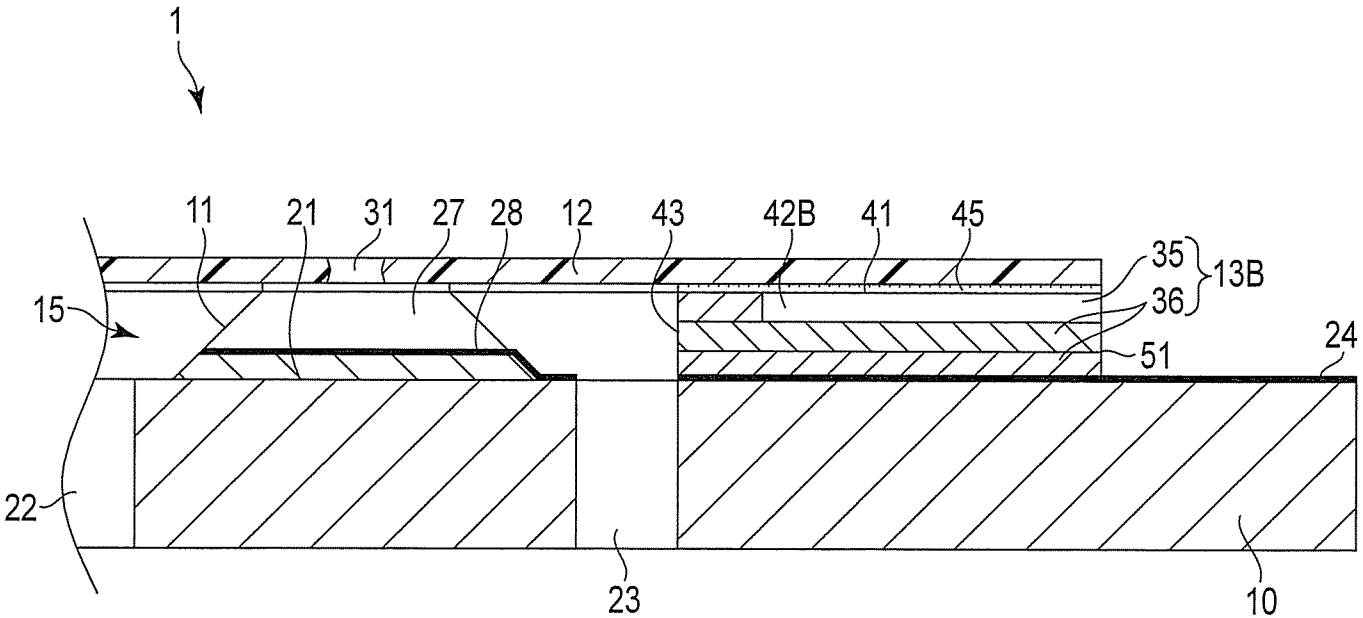
FIG. 6 is an exemplary cross-sectional view of an inkjet head of the third embodiment.

Next, a third embodiment of the inkjet head will be explained hereinafter with reference to FIG. 5 and FIG. 6. FIG. 5 is a plan view of a frame 13B according to the third embodiment. FIG. 6 is a cross-sectional view of an inkjet head 1 according to the third embodiment.

As illustrated in FIG. 5, an adhering surface 41 of the frame 13B is provided with a plurality of grooves 42B. Each of the grooves 42B extends from an outer edge of the frame 13B toward an inner edge of the frame 13B. As illustrated in FIG. 6, the grooves 42B are open to an outer circumference 51 of the frame 13B. On the other hand, the grooves 42B are not open to the ink chamber 15, but apart from the ink chamber 15. In other words, the grooves 42B are separated from the ink chamber 15.

According to the inkjet head 1 having the above structure, when an adhesive 45 is cured, gas which is produced by chemical reaction runs into the grooves 42B. Since the grooves 42B are open to the outer circumference of the frame 13B, the gas is released into the atmosphere. Thereby, it is further suppressed that air bubbles produce projections on the surface of the nozzle plate 12.

Figure 7:
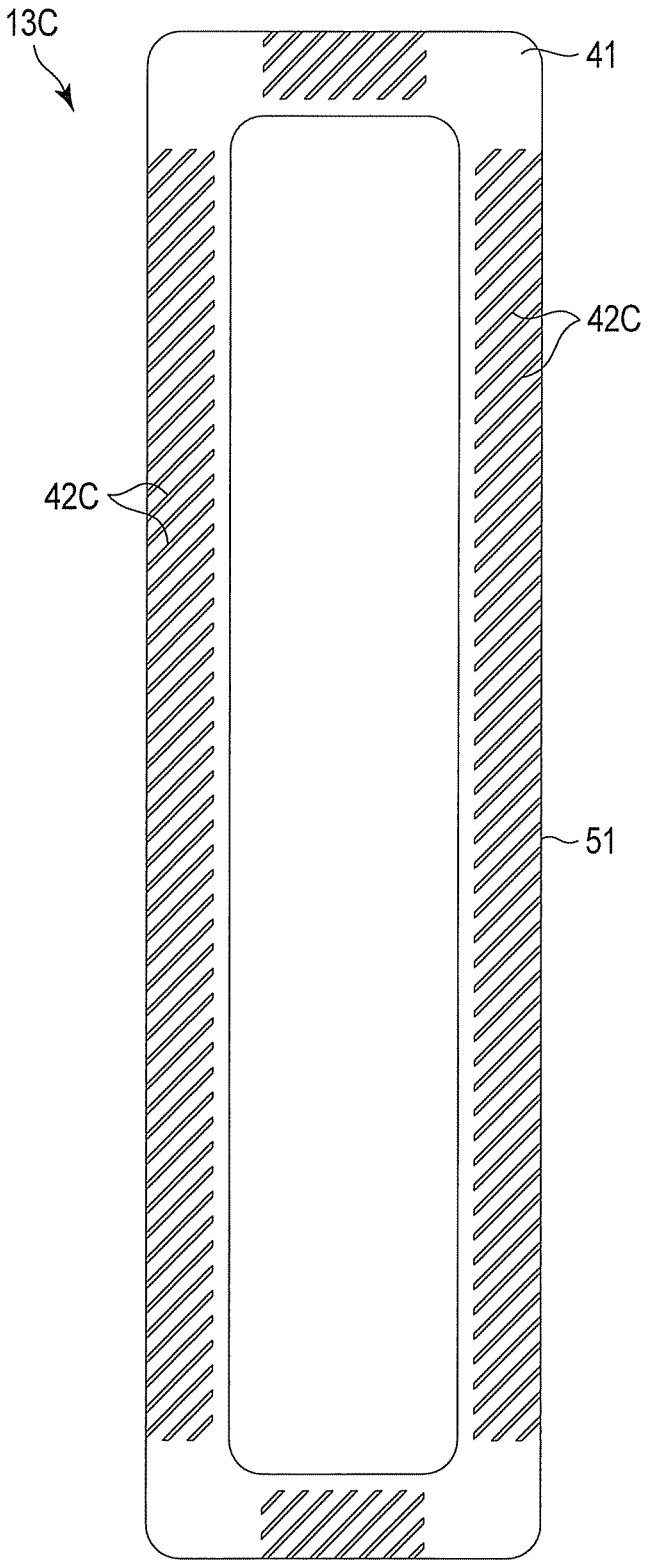
FIG. 7 is an exemplary plan view of a frame according to a fourth embodiment.

Next, a fourth embodiment of the inkjet head will be explained hereinafter with reference to FIG. 7. FIG. 7 is a plan view of a frame 13C according to the fourth embodiment. As illustrated in FIG. 7, an adhering surface 41 of the frame 13C is provided with a plurality of grooves 42C. Each of the grooves 42C extends to obliquely cross an edge of the frame 13C. The grooves 42C are open to an outer circumference 51 of the frame 13C. The frame 13C having the above structure has the same function as that of the frame 13C of the third embodiment.

Figure 8:
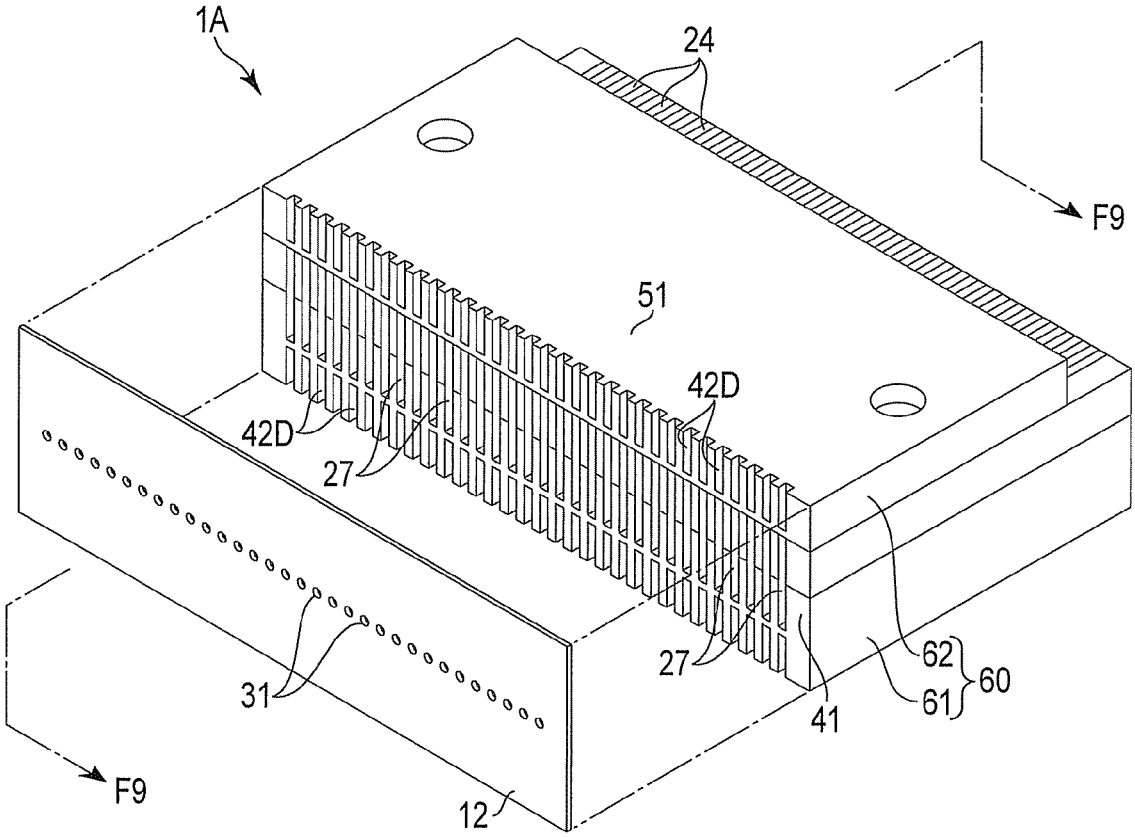
FIG. 8 is an exemplary perspective view of an inkjet head according to a fifth embodiment.
Figure 9:
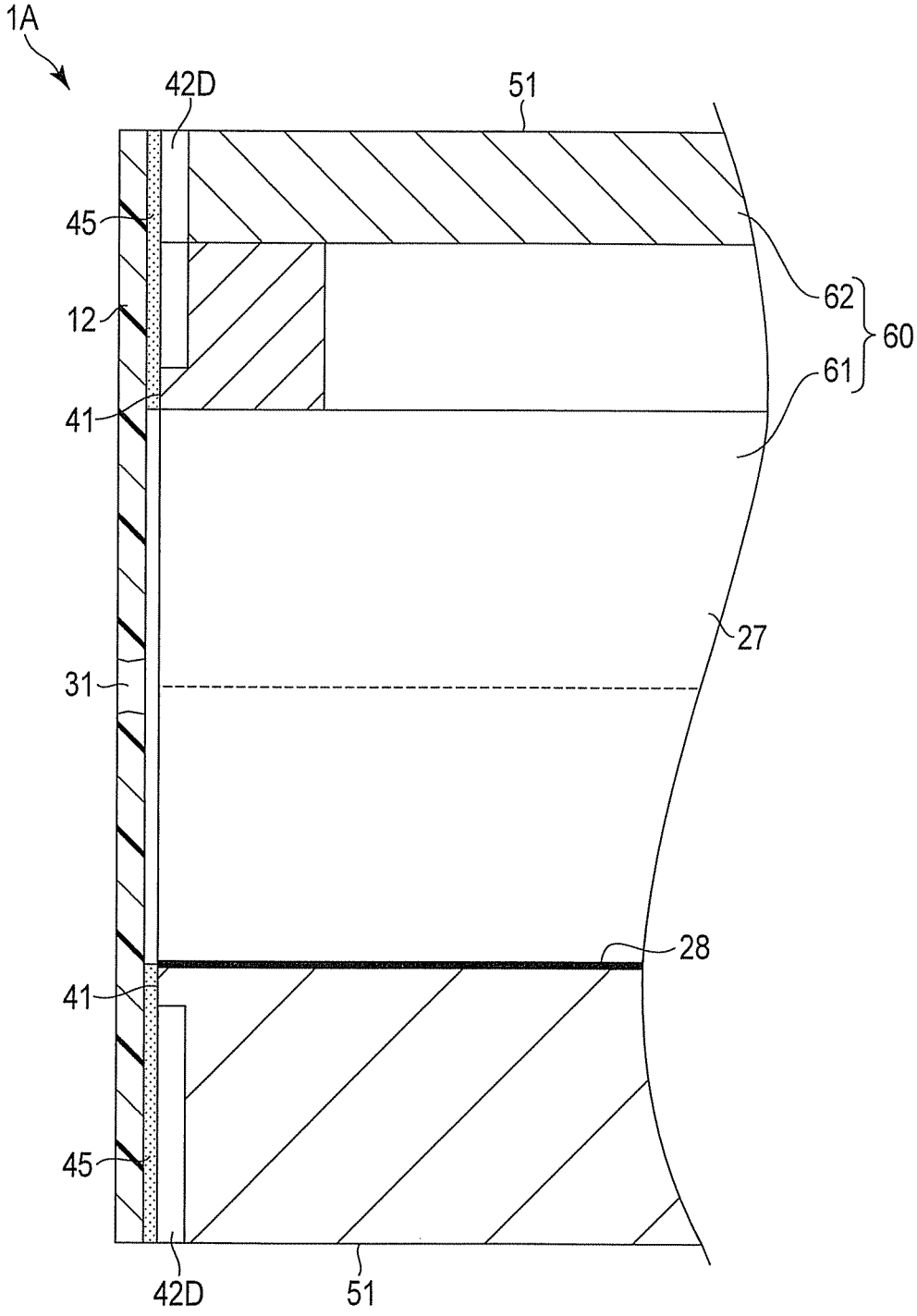
FIG. 9 is an exemplary cross-sectional view of the inkjet head of the fifth embodiment, taken along line F9-F9 of FIG. 8.

Next, a fifth embodiment of the inkjet head will be explained hereinafter with reference to FIG. 8 and FIG. 9. FIG. 8 is an exploded perspective view of an inkjet head 1A according to the fifth embodiment. FIG. 9 is a cross-sectional view of the inkjet head 1A, taken along line F9-F9 of FIG. 8.

As illustrated in FIG. 8, the inkjet head 1A of the fifth embodiment is an inkjet head of a so-called end-shooter type. The inkjet head 1A includes a nozzle plate 12, and a base module 60.

The base module 60 includes a driving element 61 and a cover 62. The driving element 61 is formed in a block shape by two PZT members which are bonded to each other. The driving element 61 is provided with a plurality of electrical traces 24, a plurality of pressure chambers 27, and a plurality of grooves 42D.

The cover 62 is attached to the driving element 61. The cover 62 includes a plurality of grooves 42D, and a channel which is provided inside the cover 62. The channel is connected to an ink tank and the pressure chambers 27. Ink of the ink tank is supplied to the pressure chambers 27 through the channel of the cover 62.

The base module 60, which is formed by attaching the cover 62 to the driving element 61, has an adhering surface 41. The grooves 42D of the driving element 61 and the grooves 42D of the cover 62 are provided in the adhering surface 41. As illustrated in FIG. 9, each of the grooves 42D is open to an outer circumference 51 of the base module 60. On the other hand, the grooves 42D are not open to the pressure chambers 27, but apart from the pressure chambers 27. In other words, the grooves 42D are separated from the pressure chambers 27.

The inkjet head 1A having the above structure has the same function as the inkjet head 1 of the third embodiment. Specifically, gas which is produced from an adhesive 45 when the adhesive 45 is cured runs into the grooves 42D. In addition, since the grooves 42D are open to the outer circumference of the base module 60, the gas is released into the atmosphere. Therefore, it is suppressed that projections are formed on the surface of the nozzle plate 12. As described above, even the inkjet head 1A of a so-called end-shooter type produces the same effect as the inkjet head 1 of the side-shooter type.

In addition, the grooves 42D of the base module 60 are provided apart from the pressure chambers 27. Therefore, it is possible to prevent ink of the pressure chambers 27 from flowing into the grooves 42D and thereby remaining and changing ink ejection performance.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An inkjet head comprising:

a base member;

a nozzle plate which is opposed to the base member;

a frame which is interposed between the base member and the nozzle plate, the frame including an adhering surface to which the nozzle plate is adhered, and a groove which is provided in the adhering surface; and an adhesive which is interposed between the between the adhering surface and the nozzle plate;

wherein the frame includes a first plate which includes the adhering surface and a slit which is open to the adhering surface, and a second plate which is bonded to the first plate, and the groove is formed of the slit of the first plate.

2. The inkjet head of claim 1, wherein the nozzle plate is formed of resin.

3. The inkjet head of claim 2, wherein the frame encloses an ink chamber to which ink is supplied, and the groove is separated from the ink chamber.

4. The inkjet head of claim 1, wherein the groove extends along an edge of the frame.

5. An inkjet head comprising:

a base member;

a nozzle plate which is opposed to the base member;

a frame which is interposed between the base member and the nozzle plate, the frame including an adhering surface to which the nozzle plate is adhered, and a groove which is provided in the adhering surface; and an adhesive which is interposed between the adhering surface and the nozzle plate, wherein the groove is open to an outer circumference of the frame.

6. The inkjet head of claim 5, wherein the nozzle plate is formed of resin.

7. An inkjet head comprising:

a base member;

a nozzle plate which is opposed to the base member;

a frame which is interposed between the base member and the nozzle plate, the frame including an adhering surface to which the nozzle plate is adhered, and a groove which is provided in the adhering surface; and an adhesive which is interposed between the adhering surface and the nozzle plate, wherein the groove extends obliquely with respect to an edge of the frame.

8. An inkjet head comprising:

a nozzle plate which includes a plurality of nozzle holes;

a base module that includes a plurality of pressure chambers which correspond to the respective nozzle holes and to which ink is supplied, an adhering surface to which the nozzle plate is adhered, and a groove which is provided in the adhering surface; and an adhesive which is interposed between the adhering surface and the nozzle plate;

wherein the groove is open to an outer circumference of the base module.

9. The inkjet head of claim 8, wherein the nozzle plate is formed of resin.

10. The inkjet head of claim 9, wherein the groove is separated from the pressure chambers.

* * * * *